US011347158B2

(12) United States Patent
Fukumoto et al.

(10) Patent No.: US 11,347,158 B2
(45) Date of Patent: May 31, 2022

(54) IMAGE FORMING APPARATUS INCLUDING OPTICAL PRINT HEAD

(71) Applicant: CANON KABUSHIKI KAISHA, Tokyo (JP)

(72) Inventors: Ryota Fukumoto, Ibaraki (JP); Shinichiro Hosoi, Tokyo (JP); Takehiro Ishidate, Tokyo (JP); Toshiki Momoka, Tokyo (JP); Yuta Okada, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/112,827

(22) Filed: Dec. 4, 2020

(65) Prior Publication Data

US 2021/0173324 A1 Jun. 10, 2021

(30) Foreign Application Priority Data

Dec. 10, 2019 (JP) ..... JP2019-223283

(51) Int. Cl.
*G03G 15/04* (2006.01)

(52) U.S. Cl.
CPC . *G03G 15/04036* (2013.01); *G03G 15/04054* (2013.01); *G03G 2221/1654* (2013.01)

(58) Field of Classification Search
CPC ..... G03G 15/04036; G03G 15/04054; G03G 2221/1654
See application file for complete search history.

(56) References Cited

U.S. PATENT DOCUMENTS

2007/0058180 A1* 3/2007 Inoue ..... B41J 2/451 358/1.5
2013/0170855 A1* 7/2013 Mori ..... G03G 15/043 399/110
2015/0346629 A1* 12/2015 Nagamine ..... G03G 15/0409 347/118
2017/0277115 A1* 9/2017 Yamamura ..... G03G 21/1633
2018/0364613 A1* 12/2018 Momoka ..... G03G 15/04036
2019/0346809 A1* 11/2019 Iwai ..... G03G 21/1666
2020/0117113 A1* 4/2020 Iwai ..... G03G 21/1666

FOREIGN PATENT DOCUMENTS

JP 2014213541 A 11/2014

OTHER PUBLICATIONS

English machine translation of Mikami et al. (JP 2014-213541 A) (Year: 2014).*

* cited by examiner

*Primary Examiner* — Walter L Lindsay, Jr.
*Assistant Examiner* — Geoffrey T Evans
(74) *Attorney, Agent, or Firm* — Canon U.S.A., Inc. I.P. Division

(57) ABSTRACT

In a configuration in which a metal holder is supported by a resin member, the metal holder cannot be grounded, so that electricity may be discharged from the charged holder to a substrate held by the holder. The holder is provided with a pin to determine a position of the holder with respect to a photosensitive member. A conductive member that is made of metal and is grounded, is brought into contact with the pin to thereby enable the holder to be grounded through the pin.

8 Claims, 12 Drawing Sheets

IMAGE FORMING APPARATUS INCLUDING OPTICAL PRINT HEAD

BACKGROUND

Field of the Disclosure

The present disclosure relates to a ground configuration for an image forming apparatus including an optical print head.

Description of the Related Art

There are image forming apparatuses, such as a printer and a copying machine, that use an optical print head including a plurality of light-emitting elements for exposing the surface of a photosensitive drum. Examples of the light-emitting elements of the optical print head include, a light-emitting diode (LED), and an organic electroluminescence (EL) element. A plurality of light-emitting elements is arranged, for example, in one row or two rows in a staggered manner along a rotational axis direction of the photosensitive drum. The optical print head includes a lens array for collecting light emitted from the light-emitting elements and focusing the light on the surface of the photosensitive drum. The lens array is disposed between the light-emitting elements and the photosensitive drum such that the lens array faces the surface of the photosensitive drum. Light emitted from the light-emitting elements is collected and focused on the surface of the photosensitive drum through the lens array. In this manner, an electrostatic latent image is formed on the surface of the photosensitive drum.

In a case of forming the electrostatic latent image on the surface of the photosensitive drum, the optical print head may be disposed in proximity to the photosensitive drum with an interval of about 3 mm between the lens array and the photosensitive drum. If the interval between the optical print head and the photosensitive drum is small, part of a drum cartridge may contact the optical print head, for example, when the photosensitive drum is replaced with a new one. In this regard, there is an optical print head provided with a movement mechanism for moving a photosensitive drum to a position (exposure position) for exposing the surface of the photosensitive drum and to a position (retracted position) farther from the photosensitive drum than the exposure position (Japanese Patent Application Laid-Open No. 2014-213541).

Japanese Patent Application Laid-Open No. 2014-213541 discusses a holder (housing) that holds a substrate having LED elements and an advancing/retracting mechanism that supports the holder. The holder is formed of a metal block or sheet metal. The advancing/retracting mechanism has a lift member made of metal. The lift member ascends or descends along with an operation of pushing up or down a lever on the front side of an image forming apparatus, thereby moving the holder to the exposure position or to the retracted position.

In the above configuration, replacement of a metal component constituting the advancing/retracting mechanism with a resin component can obtain advantages, including a reduction in weight, corrosion prevention, and a reduction in cost. Assume a case where the lift member made of metal is replaced with a resin component in the configuration discussed in Japanese Patent Application Laid-Open No. 2014-213541. If the lift member is made of resin, the metal holder may not be grounded in some cases inside the image forming apparatus. In this case, if the holder is charged with static electricity, the electricity may discharge from the holder to the substrate. For this reason, in a case where the lift member that supports the holder is made of resin, the holder needs to be grounded.

SUMMARY

According to an aspect of the present disclosure, an image forming apparatus includes a photosensitive member unit having a photosensitive member, a holder made of metal, the holder being configured to hold a light-emitting element configured to emit light for exposing the photosensitive member and a lens configured to focus the light emitted from the light-emitting element onto the photosensitive member, a pin provided on the holder on one side of the lens in a longitudinal direction of the holder, the pin being brought into contact with a frame of the photosensitive member unit to form a gap between the photosensitive member and the lens, the pin protruding from both sides of the holder in an optical axis direction of the lens, a support member made of resin and configured to support the holder, the support member being configured to move the holder to a first position where the pin contacts the frame and to a second position farther from the photosensitive member than the first position, and a conductive member made of metal and grounded, the conductive member being in contact with a portion of the pin protruding from the holder in a direction away from the photosensitive member.

Further features of the present disclosure will become apparent from the following description of exemplary embodiments with reference to the attached drawings.

BRIEF DESCRIPTION OF THE DRAWINGS

FIGS. 4A, 4B1, 4B2, 4C1, and 4C2 are schematic views each illustrating a configuration of a substrate and a lens array.

DESCRIPTION OF THE EMBODIMENTS

Exemplary embodiments will now be described below with reference to the drawings. The scope of the disclosure is not intended to be limited only to the dimensions, materials, shapes, relative arrangements, and the like of components described in the following exemplary embodiments, unless otherwise specified.

(Image Forming Apparatus)

Figure 1A:
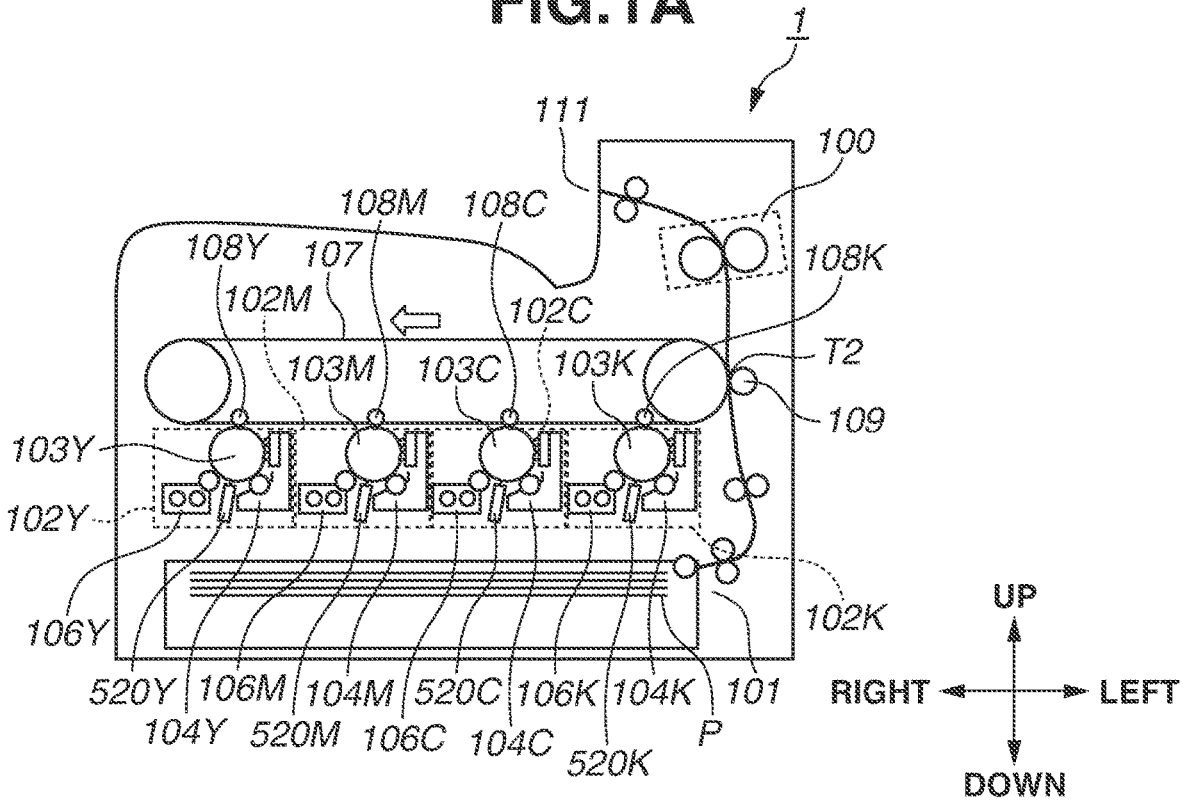
FIGS. 1A and 1B are schematic sectional views each illustrating an image forming apparatus.

A schematic configuration of an image forming apparatus 1 will now be described. FIG. 1A is a schematic sectional view of the image forming apparatus 1. The image forming apparatus 1 illustrated in FIG. 1A is a color printer (single function printer (SFP)) including no scanning device. However, the image forming apparatus 1 may be a copying machine including a scanning device. The image forming apparatus 1 according to an exemplary embodiment of the present disclosure is not limited to a color image forming apparatus including a plurality of photosensitive drums 103 as illustrated in FIG. 1A. A color image forming apparatus including one photosensitive drum 103, or a monochrome image forming apparatus that forms a monochromatic image may also be used as the image forming apparatus 1.

The image forming apparatus 1 illustrated in FIG. 1A includes four sets of image forming units 102Y, 102M, 102C, and 102K (hereinafter also collectively referred to as "image forming portions 102"), which form toner images of yellow, magenta, cyan, and black, respectively. The image forming units 102Y, 102M, 102C, and 102K include photosensitive drums 103Y, 103M, 103C, and 103K, respectively (hereinafter also collectively referred to as "photosensitive drums 103"). The image forming portions 102Y, 102M, 102C, and 102K include charging devices 104Y, 104M, 104C, and 104K, respectively (hereinafter also collectively referred to as "charging devices 104"), respectively, which charge the photosensitive drums 103Y, 103M, 103C, and 103K, respectively. The image forming portions 102Y, 102M, 102C, and 102K include light-emitting diode (LED) exposure units 520Y, 520M, 520C, and 520K, respectively (hereinafter also collectively referred to as "exposure units 520"), which serve as exposure light sources that emit light to expose the surfaces of the photosensitive drums 103Y, 103M, 103C, and 103K, respectively. Further, the image forming portions 102Y, 102M, 102C, and 102K include developing devices 106Y, 106M, 106C, and 106K, respectively (hereinafter also collectively referred to as "developing devices 106"), which serve as developing units that develop an electrostatic latent image formed on the photosensitive drum 103 with toner to develop toner images of the respective colors on the photosensitive drums 103. Letters "Y", "M", "C", and "K", which are added to reference numerals, indicate colors of toner.

Figure 1B:
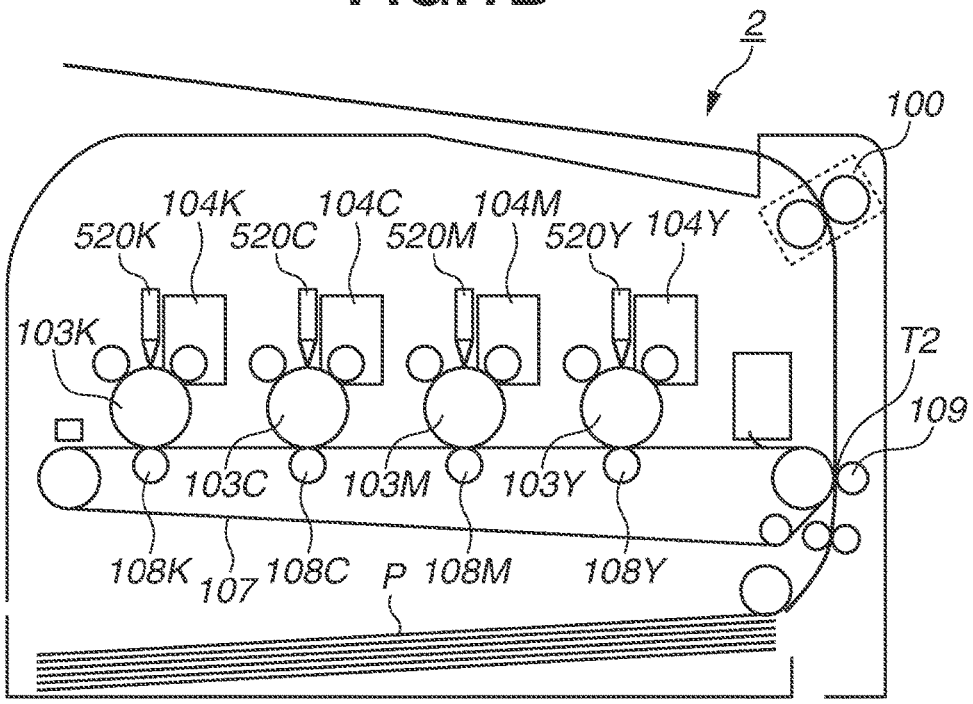

The image forming apparatus 1 illustrated in FIG. 1A is an image forming apparatus that adopts a so-called "lower surface exposure method" for exposing the surface of the photosensitive drum 103 from below. Hereinafter, a description will be given on the premise that the image forming apparatus 1 adopts the lower surface exposure method. However, the image forming apparatus 1 may adopt an "upper surface exposure method" for exposing the surface of the photosensitive drum 103 from above, like in an image forming apparatus 2 illustrated in FIG. 1B according to the present exemplary embodiment. In FIG. 1B, components having configurations similar to those illustrated in FIG. 1A are denoted by the same reference symbols.

The image forming apparatus 1 includes an intermediate transfer belt 107 onto which the toner images formed on the surface of the photosensitive drums 103 are transferred, and primary transfer rollers 108 (e.g., primary transfer rollers 108Y, 108M, 108C, and 108K) configured to sequentially transfer the toner images formed on the surface of the photosensitive drums 103 onto the intermediate transfer belt 107. The image forming apparatus 1 also includes a secondary transfer roller 109 and a fixing device 100. The secondary transfer roller 109 serves as a transfer unit that transfers the toner images formed on the intermediate transfer belt 107 onto a recording sheet P which has been conveyed from a sheet feed portion 101. The fixing device 100 fixes the secondarily transferred image onto the recording sheet P.

(Image Forming Process)

The exposure unit 520Y exposes the surface of the photosensitive drum 103Y, which is charged by the charging device 104Y. Thus, an electrostatic latent image is formed on the surface of the photosensitive drum 103Y. The developing device 106Y develops the electrostatic latent image formed on the surface of the photosensitive drum 103Y with yellow toner. The yellow toner image developed on the surface of the photosensitive drum 103Y is transferred onto the intermediate transfer belt 107 by the primary transfer roller 108Y. Magenta, cyan, and black toner images are also transferred onto the intermediate transfer belt 107 in an image forming process similar to that described above.

The toner images of the respective colors transferred onto the intermediate transfer belt 107 are conveyed to a secondary transfer portion T2 by the intermediate transfer belt 107. A transfer bias for transferring the toner images onto the recording sheet P is applied to the secondary transfer roller 109 disposed at the secondary transfer portion T2. The toner images conveyed to the secondary transfer portion T2 are transferred onto the recording sheet P, which has been conveyed from the sheet feed portion 101, by the transfer bias of the secondary transfer roller 109. The recording sheet P onto which the toner images are transferred is conveyed to the fixing device 100. The fixing device 100 fixes the toner images onto the recording sheet P with heat and pressure. The recording sheet P undergone the fixing process by the fixing device 100 is discharged onto a discharge portion 111.

(Drum Units and Developing Units)

Drum units 518Y, 518M, 518C, and 518K (hereinafter also collectively referred to as "drum units 518") each including the photosensitive drum 103 are attached to the image forming apparatus 1. In the present exemplary embodiment, the drum units 518 are also referred to as photosensitive member units. The drum units 518 are cartridges that can be replaced by an operator, such as a user or a person in charge of maintenance. The drum units 518 rotatably support the photosensitive drums 103. In this case, the drum units 518 also function as drum support members that rotatably support the photosensitive drums 103. In the present exemplary embodiment, each drum unit 518 includes each drum support member. Specifically, the photosensitive drums 103 are rotatably supported by a frame of the drum units 518. The drum units 518 may be configured without the charging devices 104 and a cleaning device.

Developing units 641Y, 641M, 641C, and 641K (hereinafter also collectively referred to as "developing units 641"), each of which is provided separately from each of the drum units 518, are attached to the image forming apparatus 1 according to the present exemplary embodiment. The developing units 641 according to the present exemplary embodiment are cartridges having a configuration in which each of the developing devices 106 illustrated in FIG. 1A and a toner storage portion are integrated. Each developing device 106 includes a developing sleeve (not illustrated) that carries developer. Each developing unit 641 is provided with a plurality of gears for rotating a screw for stirring toner and carrier. If these gears degrade with time, the operator detaches the developing unit 641 from an apparatus body of the image forming apparatus 1 to replace the developing unit 641 with another unit. The configuration of the drum units 518 and the developing units 641 according to the present exemplary embodiment may also take a configuration of a process cartridge in which the drum unit 518 and the developing unit 641 described above are integrated.

Figure 2A:
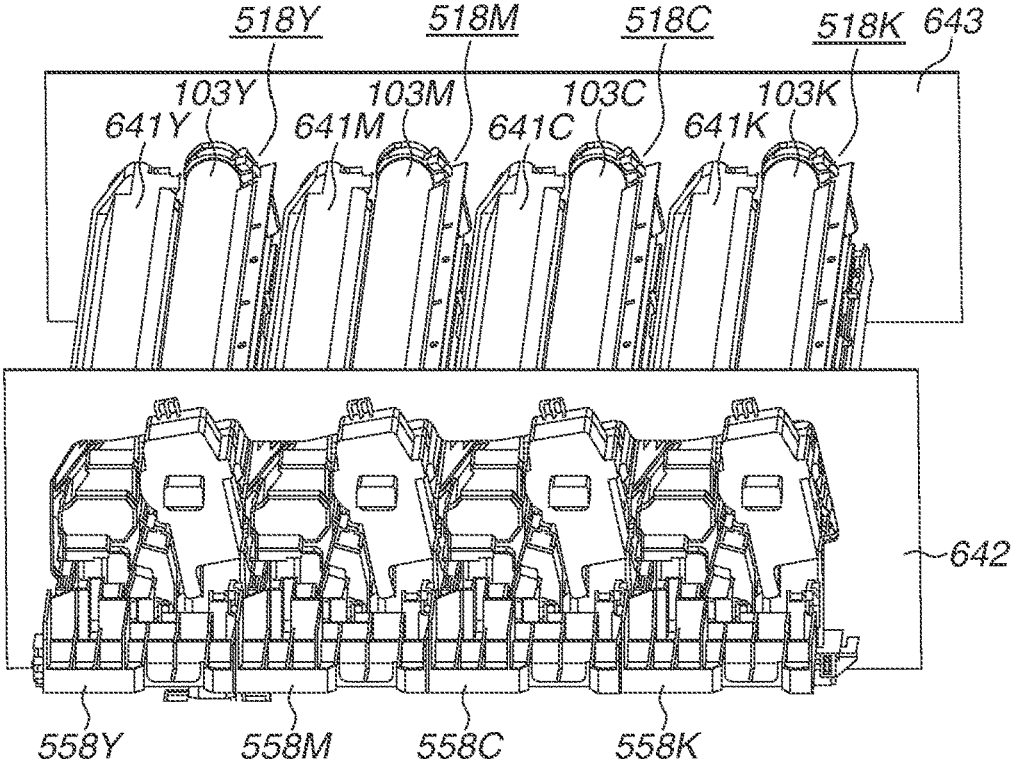
FIGS. 2A and 2B are perspective views each illustrating a structure in the vicinity of drum units and developing units of the image forming apparatus.
Figure 2B:
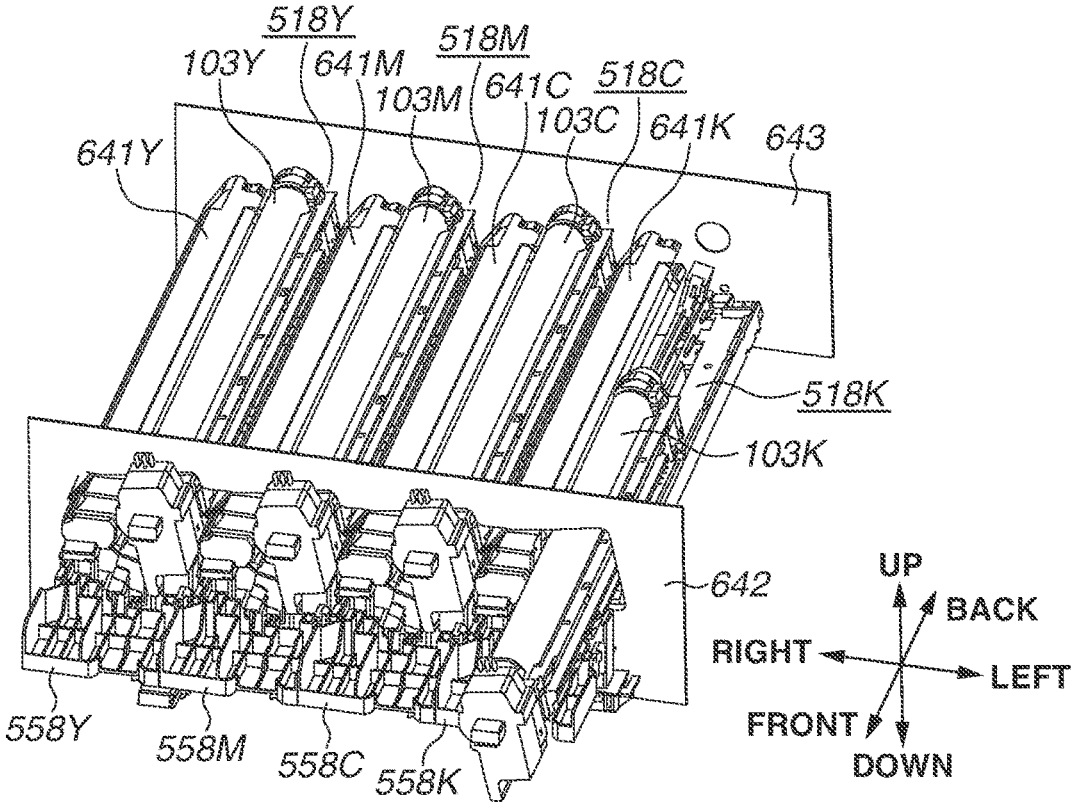

FIG. 2A is a perspective view illustrating a schematic structure of a peripheral portion of the drum units 518 (e.g., the drum units 518Y, 518M, 518C, and 518K) included in the image forming apparatus 1 and a peripheral portion of the developing units 641 (e.g., the developing units 641Y, 641M, 641C, and 641K) included in the image forming apparatus 1. FIG. 2B is a perspective view illustrating a state where the drum units 518 are inserted into the image forming apparatus 1 from the outside of the apparatus body.

As illustrated in FIG. 2A, the image forming apparatus 1 includes a front side plate 642 formed of a sheet metal, and a back side plate 643 also formed of a sheet metal. The front side plate 642 is a side wall provided on the front side of the image forming apparatus 1. The front side plate 642 forms a part of a housing of the apparatus body on the front side of the main body of the image forming apparatus 1. The back side plate 643 is a side wall provided on the back side of the image forming apparatus 1. The back side plate 643 forms a part of the housing of the apparatus body on the back side of the main body of the image forming apparatus 1. As illustrated in FIG. 2A, the front side plate 642 and the back side plate 643 are disposed facing each other, and a sheet metal (not illustrated) serving as a beam is bridged between the front side plate 642 and the back side plate 643. The front side plate 642, the back side plate 643, and the beam (not illustrated) form a part of the frame of the image forming apparatus 1. In this case, a front side or near side of the image forming apparatus 1 or of each component of the image forming apparatus 1 according to the present exemplary embodiment is a side where the drum units 518 are inserted into or removed from the apparatus body.

The front side plate 642 is provided with an opening for inserting or removing the drum unit 518 and the developing unit 641 into or from the apparatus body from the front side of the image forming apparatus 1. Each of the drum units 518 and the developing units 641 is mounted at a predetermined position (mounting position) in the main body of the image forming apparatus 1 through the opening. The image forming apparatus 1 also includes covers 558Y, 558M, 558C, and 558K (hereinafter also collectively referred to as "covers 558") that cover the near side of each of the drum units 518 and the developing units 641 mounted at the mounting position. One end of each cover 558 is fixed to the main body of the image forming apparatus 1 with a hinge, and the hinge enables the cover 558 to be rotated with respect to the main body of the image forming apparatus 1. The operator opens the cover 558 to pull the drum unit 518 or the developing unit 641 out of the main body, inserts another drum unit 518 or developing unit 641 into the main body, and closes the cover 558, to thereby complete a replacement operation.

As illustrated in FIGS. 2A and 2B, a side where the front side plate 642 is located is hereinafter defined as the front side (near side) of the apparatus body, and a side where the back side plate 643 is located is hereinafter defined as the back side (far side) of the apparatus body. With reference to the photosensitive drum 103K on which the electrostatic latent image for the black toner image is formed, a side where the photosensitive drum 103Y on which the electrostatic latent image for the yellow toner image is formed is disposed is defined as a right side. With reference to the photosensitive drum 103Y on which the electrostatic latent image for the yellow toner image is formed, a side where the photosensitive drum 103K on which the electrostatic latent image for the black toner image is formed is disposed is defined as a left side. A direction which is perpendicular to the front-back direction and left-right direction defined herein and which is a vertically upward direction is defined as an up direction. A direction which is perpendicular to the front-back direction and left-right direction defined herein and which is a vertically downward direction is defined as a down direction. The front direction, the back direction, the right direction, the left direction, the up direction, and the down direction, which are defined above, are illustrated in FIG. 2B. A term "rotational axis direction" of the photosensitive drum 103 used herein refers to a direction that coincides with the front-back direction illustrated in FIG. 2B. The term "longitudinal direction" of the optical print head 105 also refers to the direction that coincides with the front-back direction illustrated in FIG. 2B. In other words, the rotational axis direction of the photosensitive drum 103 and the longitudinal direction of the optical print head 105 coincide with each other.

(Exposure Unit)

The exposure units 520 including the optical print heads 105 will now be described. Each optical print head 105 forms a longitudinal shape extending in the rotational axis direction of each photosensitive drum 103. Each optical print head 105 includes a holding member 505, a lens array 506, and a substrate (not illustrated). The lens array 506 and the substrate (not illustrated) are held by the holding member 505. The holding member 505 is, for example, a metal member and is formed by bending a plate material obtained by performing a plating process on a galvanized steel plate or cold-rolled steel plate. The holding member 505 is a magnetic material that becomes magnetized when the holding member 505 is placed in a magnetic field. Examples of an exposure method used for an electrophotographic image forming apparatus include a laser beam scanning exposure method. In the method, irradiation beams emitted from a semiconductor laser scan with a polygon mirror to expose the surface of a photosensitive drum through, for example, an f-θ lens. The optical print head 105 described in the present exemplary embodiment is used for an LED exposure method; the method exposes the surface of a photosensitive drum 103 using light-emitting elements, such as LEDs arranged along the rotational axis direction of the photosensitive drum 103. The optical print head 105 is not used for the above-described laser beam scanning exposure method.

Figure 3:
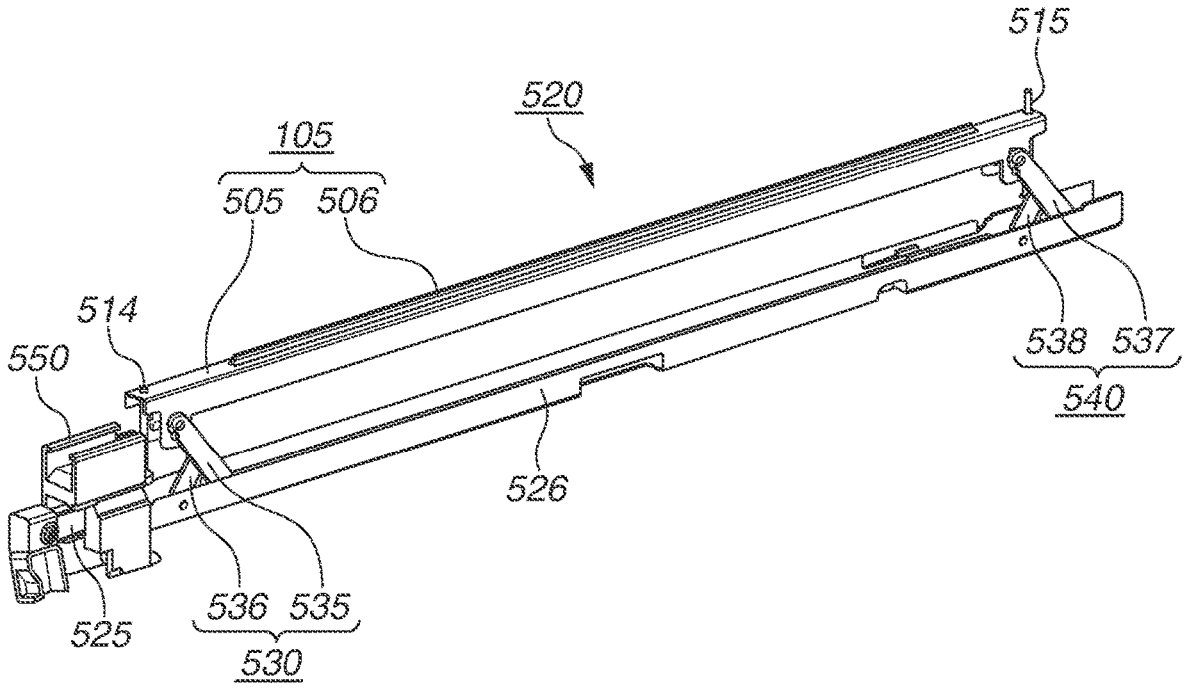
FIG. 3 is a schematic perspective view of an exposure unit.

The exposure unit 520 described in the present exemplary embodiment is provided on the lower side in the vertical direction relatively to the rotational axis of the photosensitive drum 103. On the substrate (not illustrated) included in the holding member 505, LEDs serving as light-emitting elements are provided. These light-emitting elements expose the surface of the photosensitive drum 103 from below. However, the exposure unit 520 may be provided on the upper side in the vertical direction relatively to the rotational axis of the photosensitive drum 103 and may expose the surface of the photosensitive drum 103 from above as illustrated in FIG. 1B. FIG. 3 is a schematic perspective view illustrating the exposure unit 520 included in the image forming apparatus 1 according to the present exemplary embodiment.

As illustrated in FIG. 3, the exposure unit 520 includes the optical print head 105, a support member 526 as an example of a support frame, a first link mechanism 530, and a second link mechanism 540.

As illustrated in FIG. 3, the holding member 505 of the optical print head 105 is provided with a contact pin 514 and a contact pin 515. The contact pin 514 and the contact pin 515 are examples of a metal pin. For example, the contact pin 515 is provided on the holding member 505 on one side (far side) of the lens array 506 in the rotational axis direction of the photosensitive drum 103, and the contact pin 515 protrudes from both sides of the holding member 505 in the optical axis direction of the lens array 506. The contact pin 514 has a configuration similar to that of the contact pin 515. When the contact pin 514 and the contact pin 515 are brought into contact with the drum unit 518, a gap is formed between a light-emitting surface of the lens array 506 and the photosensitive drum 103. Thus, the position of the optical print head 105 is determined with respect to the photosensitive drum 103. In the present exemplary embodiment, the contact pin 514 and the contact pin 515 are straight metal pins. The contact pin 514 and the contact pin 515 are fixed to the holding member 505, which is made of metal, by welding. In the present exemplary embodiment, the contact pin 514 and the contact pin 515 are thus integrally formed with the holding member 505. However, fixing of the contact pin 514 and the contact pin 515 to the holding member 505 is not limited to welding. The fixing may be achieved with an adhesive. Alternatively, screw threads may be formed on the contact pin 514 and the contact pin 515, and the contact pin 514 and the contact pin 515 may be fastened to the holding member 505 by screwing.

The first link mechanism 530 includes a link member 535 and a link member 536. The second link mechanism 540 includes a link member 537 and a link member 538. As described in detail below, the link member 535 is attached to the back side relatively to the center of the holding member 505 in the rotational axis direction of the photosensitive drum 103. The link member 537 is attached to the front side relatively to the center of the holding member 505 in the rotational axis direction of the photosensitive drum 103.

A slide member 525 as an example of a slider described below slides in the front-back direction along with an opening/closing operation of the cover 558 provided on the front side of the image forming apparatus 1. The link members 535, 536, 537 and 538 rotate along with the slide motion of the slide member 525, thereby enabling the optical print head 105 to move in the up-down direction.

In the present exemplary embodiment, the optical print head 105 is provided on the lower side in the vertical direction relatively to the photosensitive drum 103. In other words, the optical print head 105 exposes the surface of the photosensitive drum 103 from below in the vertical direction in the image forming apparatus 1 according to the present exemplary embodiment.

As illustrated in FIG. 3, the exposure unit 520 includes the support member 526. The support member 526 supports the optical print head 105 through the first link mechanism 530 and the second link mechanism 540. Specifically, the link member 535 of the first link mechanism 530 supports the holding member 505, and the link member 537 of the second link mechanism 540 supports the holding member 505. A portion of the link member 535 that supports the holding member 505 is a first support portion made of resin. A portion of the link member 537 that supports the holding member 505 is a second support portion made of resin. The first support portion and the second support portion directly or indirectly support the holding member 505. As described in detail below, since the first support portion and the second support portion are made of resin, the holding member 505 is not grounded, i.e., in an electrically floating state.

The support member 526 is formed by bending a sheet metal into a U-shape. The support member 526 is a longitudinal shaped member extending in the rotational axis direction of the photosensitive drum 103. One end (front side) of the support member 526 in the longitudinal direction of the support member 526 is fixed to the front side plate 642. The other end (back side) of the support member 526 in the longitudinal direction of the support member 526 is fixed to the back side plate 643. The position of the support member 526 is thereby fixed with respect to the photosensitive drum 103 on the side opposite to the side where the photosensitive drum 103 is disposed with respect to the holding member 505 in the optical axis direction of the lens array 506. The support member 526 is grounded through one or both of the front side plate 642 and the back side plate 643.

The support member 526 includes the slide member 525 movable in the longitudinal direction of the support member 526. Along with the movement of the slide member 525 with respect to the support member 526, the link members 535, 536, 537 and 538 are rotated to move the optical print head 105 with respect to the support member 526.

An insertion portion 550 is fixed to the support member 526. A cleaning member 600 described below is inserted into the insertion portion 550. Since the support member 526 is fixed to the apparatus body of the image forming apparatus 1, the insertion portion 550 is also fixed to the apparatus body of the image forming apparatus 1.

Figure 4A:
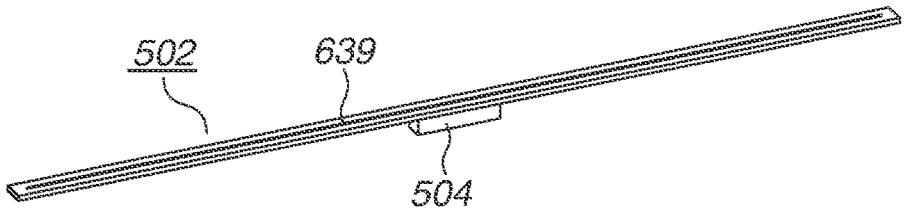
Figure 4A:
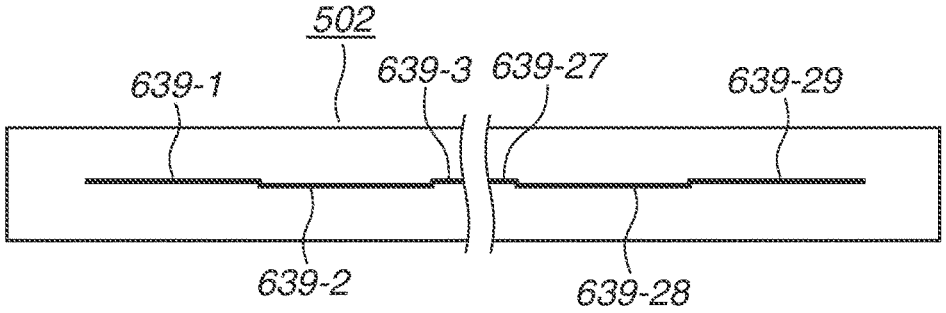
Figure 4A:
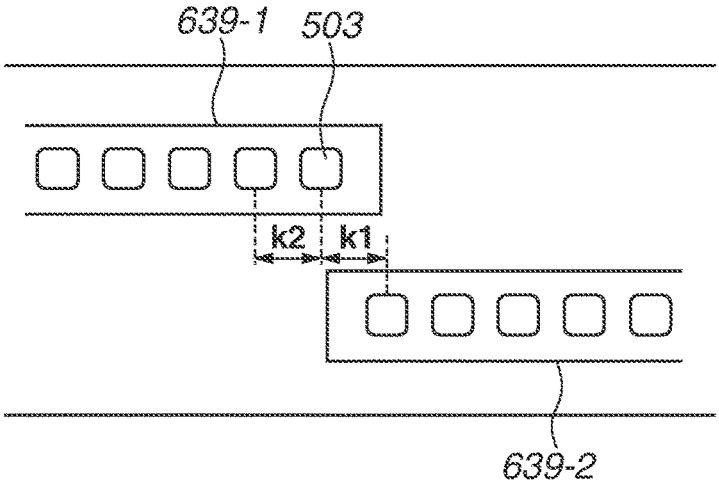
Figure 4A:
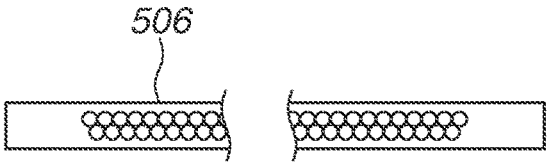
Figure 4A:
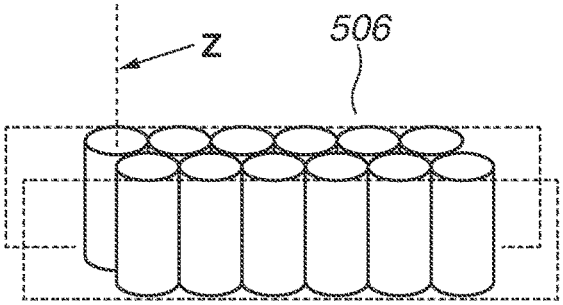

A substrate 502 and the lens array 506 held by the holding member 505 of the optical print head 105 will now be described with reference to FIGS. 4A, 4B1, 4B2, 4C1, and 4C2. First, the substrate 502 will be described. FIG. 4A is a schematic perspective view of the substrate 502. FIG. 4B1 illustrates an array of a plurality of LEDs 503 provided on the substrate 502. FIG. 4B2 is an enlarged view of FIG. 4B1.

On the substrate 502, LED chips 639 are mounted. As illustrated in FIG. 4A, the LED chips 639 are provided on one surface of the substrate 502, and a connector 504 is provided on the back surface of the substrate 502. The substrate 502 is provided with a wire for supplying signals to each of the LED chips 639. One end of a flexible flat cable (FFC) (not illustrated) is connected to the connector 504. The main body of the image forming apparatus 1 is provided with the substrate 502. The substrate 502 includes a control unit and a connector. The other end of the FFC is connected to the connector. Control signals are input to the substrate 502 from the control unit of the main body of the image forming apparatus 1 through the FFC and the connector 504. Each of the LED chips 639 is driven by the control signals input to the substrate 502.

The LED chips 639 mounted on the substrate 502 will be now described in more detail. As illustrated in FIGS. 4B1 and 4B2, 29 piece of LED chips 639-1 to 639-29 on which the plurality of LEDs 503 is disposed are arranged on one surface of the substrate 502. On each of the LED chips 639-1 to 639-29, 516 pieces of LEDs are arranged in a row in the longitudinal direction. A distance k2 between centers of adjacent LEDs in the longitudinal direction of the LED chips 639 corresponds to the resolution of the image forming apparatus 1. The resolution of the image forming apparatus 1 according to the present exemplary embodiment is 1200 dpi. The LEDs 503 are thus arranged in one row such that the distance between centers of adjacent LEDs is 21.16 μm in the longitudinal direction of the LED chips 639-1 to 639-29. The optical print head 105 according to the present exemplary embodiment has an exposure range of about 316 mm, accordingly. A photosensitive layer of the photosensitive drum 103 is formed with a width greater than or equal to 316 mm. Since the length of a long side of an A4-size recording sheet and the length of a short side of an A3-size recording sheet are 297 mm, the optical print head 105 according to the present exemplary embodiment has the exposure range capable of forming an image on A4-size and A3-size recording sheets.

The LED chips 639-1 to 639-29 are alternately arranged in two rows along the rotational axis direction of the photosensitive drum 103. Specifically, as illustrated in FIG. 4B1, the odd-numbered LED chips 639-1, 639-3, . . . , and 639-29 counted from the left side are mounted in one row along the longitudinal direction of the substrate 502. The even-numbered LED chips 639-2, 639-4, . . . , and 639-28 are mounted in one row along the longitudinal direction of the substrate 502. By arranging the LED chips 639 in this manner, as illustrated in FIG. 4B2, a distance k1 and the distance k2, which is the distance between centers of adjacent LEDs on one LED chip 639, can be set to be equal. The distance k1 is the distance between the center of the LED disposed at one end of one of adjacent LED chips 639, which are different from each other, and the center of the LED disposed at the other end of the other of the adjacent LED chips 639 in the longitudinal direction of the LED chips 639.

In the present exemplary embodiment, each of the light-emitting elements is a semiconductor LED, such as a light-emitting diode, but instead may be, for example, an organic light-emitting diode (OLED). An OLED is also referred to as an organic electroluminescence (EL) and is a current-driven light-emitting element. For example, OLEDs are arranged on a line along a main scanning direction (rotational axis direction of the photosensitive drum 103) on a substrate of a thin film transistor (TFT) and are electrically connected in parallel with a power supply line also provided along the main scanning direction.

The lens array 506 will now be described. FIG. 4C1 is a schematic view of the lens array 506 as viewed from the photosensitive drum 103. FIG. 4C2 is schematic perspective view of the lens array 506. The lens array 506 functions to collect light emitted from the LEDs 503 on the surface of the photosensitive drum 103. As illustrated in FIG. 4C1, a plurality of lenses of the lens array 506 is arranged in two rows along the arrangement direction of the plurality of LEDs 503. The lenses are alternately disposed such that one of the lenses in one of the rows of lenses is disposed to contact both of adjacent lenses in the arrangement direction of the other of the rows of lenses. Each lens is a cylindrical rod lens made of glass. Each lens includes an incidence surface on which light emitted from each LED 503 is incident, and an emitting surface from which light incident from the incidence surface is emitted. The material of each lens is not limited to glass, but instead may be plastic. The shape of each lens is not limited to a cylindrical shape, but instead may be, for example, a polygonal column such as a hexagonal column.

A dashed line Z illustrated in FIG. 4C2 indicates a lens optical axis. The above-described movement mechanism moves the optical print head 105 in a direction that is substantially along the lens optical axis indicated by the dashed line Z. The term "lens optical axis" used herein refers to a line that connects a focal point of a lens and the center of the light-emitting surface of the lens, the lens being any one of the plurality of lenses constituting the lens array 506. To be exact, the optical axis may slight vary from lens to lens. Even when an angle formed between the optical axis of a certain lens and the optical axis of another lens is not 0 degrees, the angle may be only a small angle. When the term "lens optical axis" is used, such a slight difference is not taken into consideration, and assume that the "lens optical axis" indicates the optical axis of any one of the plurality of lenses constituting the lens array 506. Also, assume that the direction of the optical axis of one lens coincides with the direction of the optical axis of another lens.

Figure 5:
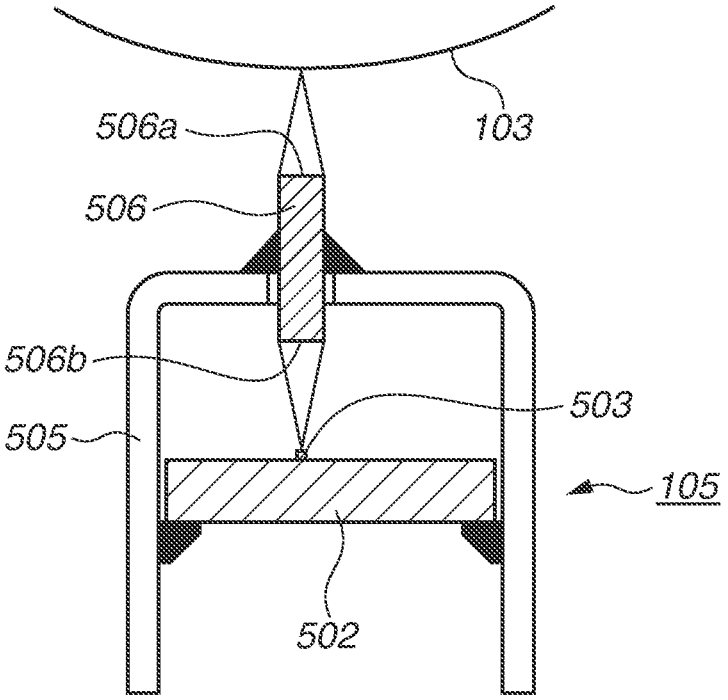
FIG. 5 illustrates a positional relationship between the substrate and the lens array and a positional relationship between the lens array and a photosensitive drum.

FIG. 5 is a sectional view of the optical print head 105 when the optical print head 105 is vertically taken along the longitudinal direction of the optical print head 105. As illustrated in FIG. 5, the substrate 502 and the lens array 506 are held by the holding member 505 such that the substrate 502 and the lens array 506 face each other. The holding member 505 is, for example, a plate material obtained by performing a plating process on a galvanized steel plate or cold-rolled steel plate. In the present exemplary embodiment, the holding member 505 is formed by bending the plate material into a U-shape. The use of a metal plate material makes it possible to obtain a strength by performing a bending process, while reducing costs.

The holding member 505 is not limited to the metal plate material obtained by performing a bending process. The holding member 505 can be, for example, so-called die-cast. Die-cast is a product or manufacturing method obtained by cooling and solidifying molten metal injected into a mold (cavity). When die-cast is adopted as the manufacturing method, complex shapes can be dealt with depending on the mold shape as a basis. On the other hand, since fabricating the mold is costly, there is a disadvantage in that there is no cost advantage when there is no need to manufacture a large amount of the same product. In the present exemplary embodiment, the holding member 505 may be manufactured by bending a metal plate or may be manufactured by adopting die-cast.

The lens array 506 focuses light beams emitted from the LEDs 503 on the photosensitive drum 103 as an unmagnified erect image. In this case, a distance from each LED 503 to a light incidence surface 506*b* of the lens array 506 is substantially equal to a distance from a light-emitting surface 506*a* of the lens array 506 to the surface of the photosensitive drum 103.

(Movement Mechanism)

Figure 6A:
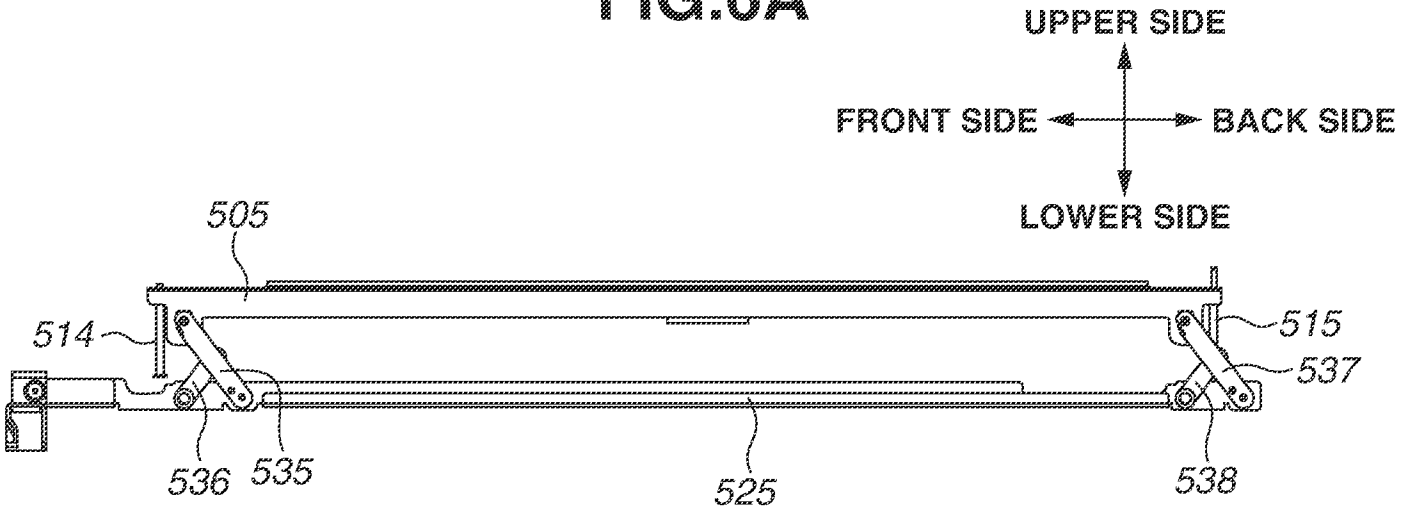
FIGS. 6A and 6B are schematic views each illustrating a state where an optical print head moves to an exposure position and to a retracted position.
Figure 6B:
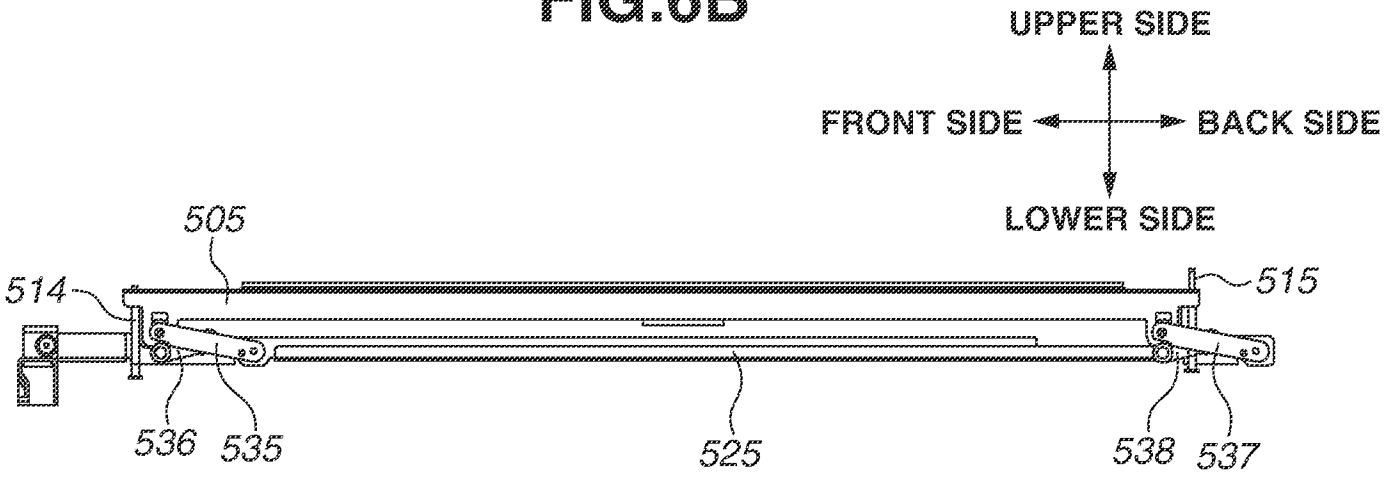

A mechanism for moving the optical print head 105 along with the slide motion of the slide member 525 will now be described with reference to FIGS. 6A and 6B. FIGS. 6A and 6B are schematic views of the exposure unit 520 as viewed from the left side. For ease of explanation, the support member 526 is not illustrated. FIG. 6A illustrates a state where the optical print head 105 is located at an exposure position (an example of a first position) for exposing the surface of the photosensitive drum 103. In contrast, FIG. 6B illustrates a state where the optical print head 105 is located at a retracted position (an example of a second position) to which the optical print head 105 is retracted from the photosensitive drum 103 relatively to the exposure position. In the present exemplary embodiment, an interval between the photosensitive drum 103 and the light-emitting surface of the lens array 506 is about 3 mm when the optical print head 105 is located at the exposure position.

As illustrated in FIGS. 6A and 6B, the link member 535 is rotatably connected to one end of the slide member 525 in the longitudinal direction of the slide member 525, and the link member 537 is rotatably connected to the other end of the slide member 525 in the longitudinal direction of the slide member 525. The slide member 525 slides to the back side from the front side when the cover 558 (not illustrated) rotates to an open state from a closed state. When the slide member 525 slides from the front side to the back side, the link member 535 and the link member 537 rotate in a counterclockwise direction in FIGS. 6A and 6B. The link member 535 and the link member 536 are rotatably connected to each other. The link member 537 and the link member 538 are also rotatably connected to each other.

One end of the link member 536 is rotatably connected to the support member 526 (not illustrated). Thus, the link member 536 also rotates with respect to the support member 526 along with the rotation of the link member 535. One end of the link member 538 is rotatably connected to the support member 526 (not illustrated). Thus, the link member 538 also rotates with respect to the support member 526 along with the rotation of the link member 537. When the slide member 525 moves from the front side to the back side, the link member 536 and the link member 538 rotate in a clockwise direction with respect to the support member 526. In this case, the other end of the link member 535 is rotatably connected to the holding member 505, and the other end of the link member 537 is rotatably connected to the holding member 505. Thus, when the link member 535 and the link member 537 are rotated in the counterclockwise direction along with the slide motion of the slide member 525 from the front side to the back side, the other end of the link member 535 and the other end of the link member 537 are moved in a direction away from the photosensitive drum 103. The optical print head 105 thereby moves to the retracted position from the exposure position.

A state will now be described where the optical print head 105 is moved from the state illustrated in FIG. 6B to the state illustrated in FIG. 6A, i.e., from the retracted position to the exposure position, along with the slide motion of the slide member 525.

The slide member 525 moves from the back side to the front side along with the rotation of the cover 558 (not illustrated) from the open state to the closed state. When the slide member 525 slides to the front side from the back side, the link member 535 and the link member 537 rotate in the clockwise direction illustrated in FIGS. 6A and 6B. At the same time, the link member 536 and the link member 538 rotate in the counterclockwise direction. When the link member 535 and the link member 537 rotate in the clockwise direction along with the slide motion of the slide member 525 from the back side to the front side, the other end of the link member 535 and the other end of the link member 537 move in a direction approaching the photosensitive drum 103. Thus, the optical print head 105 moves from the retracted position to the exposure position. In the present exemplary embodiment, the movement direction of the optical print head 105 moving between the retracted position and the exposure position substantially coincides with the optical axis direction of the lens array 506.

When the holding member 505 of the optical print head 105 moves from the retracted position to the exposure position along with the slide motion of the slide member 525, the contact pin 514, which is provided at one end of the holding member 505 in the longitudinal direction of the holding member 505, and the contact pin 515, which is provided at the other end of the holding member 505 in the longitudinal direction of the holding member 505, are brought into contact with the drum unit 518. In other words, when the optical print head 105 is located at the exposure position, the contact pin 514 and the contact pin 515 are in contact with the frame of the drum unit 518. The term "frame" used herein refers to a part of the frame of the drum unit 518. The position of the holding member 505 is thus determined with respect to the drum unit 518, i.e., the position of the optical print head 105.

When the position of the holding member 505 with respect to the drum unit 518 is determined as described above, the interval between the photosensitive drum 103 and the light-emitting surface of the lens array 506 is also determined. The movement of the optical print head 105 to the exposure position is then completed.

Figure 7A:
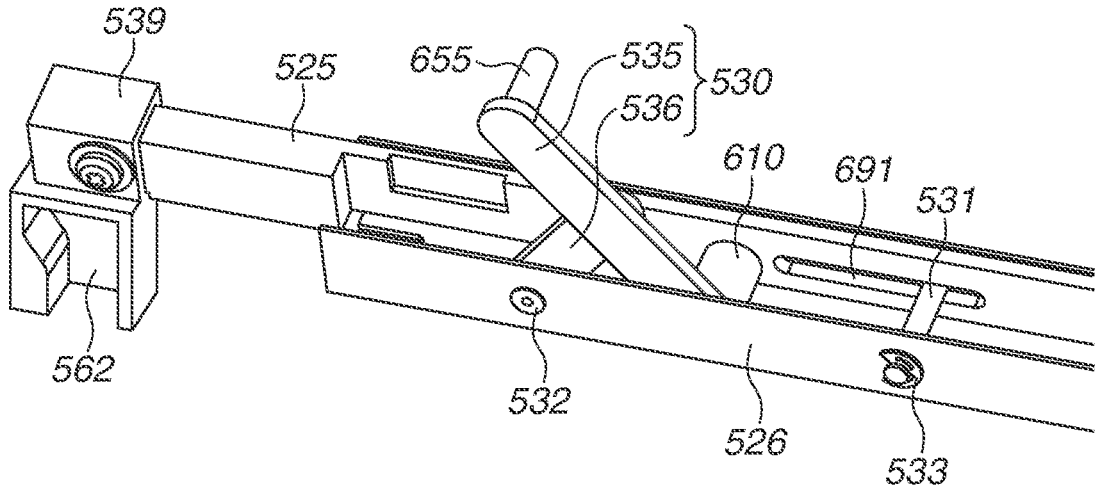
FIGS. 7A and 7B are schematic perspective views each illustrating a link mechanism as an example of a movement mechanism.
Figure 7B:
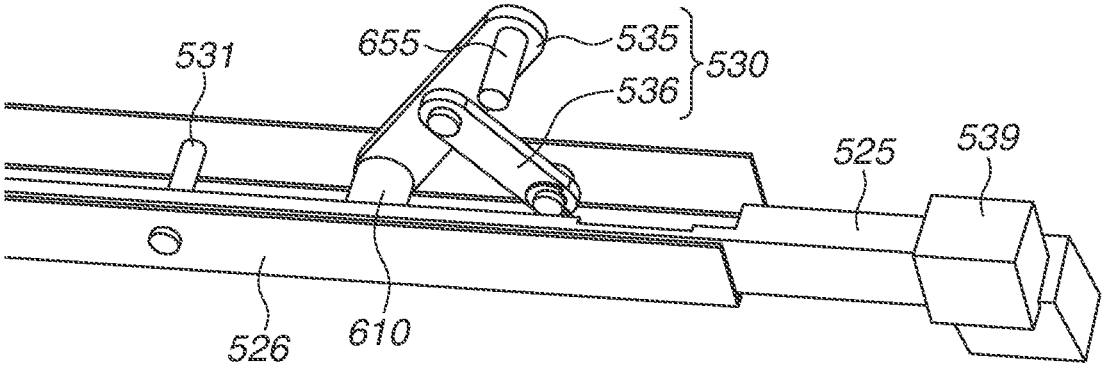

The link mechanism 530 and the link mechanism 540 will be now described in more detail with reference to FIGS. 7A and 7B and FIGS. 8A and 8B. FIG. 7A is a schematic perspective view of the support member 526 when the front side of the support member 526 is viewed from the left side. FIG. 7B is a schematic perspective view of the support member 526 when the front side of the support member 526 is viewed from the right side. The link mechanism 530 provided on the front side of the support member 526 will be described below. The configuration of the link mechanism 540 is substantially the same as the configuration of the link mechanism 530, and thus the description thereof is omitted.

As illustrated in FIGS. 7A and 7B, the support member 526 includes a support shaft 531 and an E-shaped retaining ring 533. On the surfaces of a right side wall and a left side wall of the support member 526 processed into a U-shape, holes into which the support shaft 531 is inserted are respectively formed. In a state where the support shaft 531 is inserted into these holes, the support shaft 531 is fixed to the support member 526 with the E-shaped retaining ring 533.

The slide member 525 is a plate-shaped metal member. As illustrated in FIG. 7A, the slide member 525 is provided with a long hole 691 extending in the front-back direction. The support shaft 531 is inserted into the long hole 691. In the present exemplary embodiment, the support shaft 531 is loosely fit to the long hole 691 with a gap of about 0.1 to 0.5 mm in the up-down direction. The diameter of the long hole 691 in the longitudinal direction is about 350 mm. Thus, the slide member 525 can slide in the front-back direction by about 350 mm with respect to the support member 526.

An assist member 539 is attached to one end of the slide member 525 (front side of the slide member 525) in the longitudinal direction of the slide member 525. The assist member 539 is provided with an accommodation space 562. In the accommodation space 562, a protrusion provided on the cover 558 is accommodated. When the cover 558 rotates, the protrusion moved with the rotating cover 558 is brought into contact with a side wall on the front side or a side wall on the back side of the accommodation space 562. The protrusion pushes the side wall on the front side of the accommodation space 562, thereby enabling the slide member 525 to move to the front side. In contrast, the protrusion pushes the side wall on the back side of the accommodation space 562, thereby enabling the slide member 525 to move to the back side. Thus, the slide member 525 also moves in the front-back direction along with the rotation of the cover 558.

The link mechanism 530 includes the link member 535 and the link member 536. The link member 535 and the link member 536 are longitudinal resin plate materials. In the longitudinal direction of the link member 535, a protrusion 655 is formed at one end (upper side in FIG. 7A) of the link member 535. The protrusion 655 is an example of a support portion made of resin, and an example of a first support portion made of resin. In contrast, in the longitudinal direction of the link member 535, a tube portion 610 is formed at the other end (lower side in FIG. 7A) of the link member 535. The protrusion 655 is fitted into an opening formed on the front side of the holding member 505. This enables the link member 536 to rotate about the protrusion 655 with respect to the holding member 505. The tube portion 610 is a hollow cylinder. As illustrated in FIGS. 7A and 7B, a protrusion protruding from the slide member 525 is fitted into the tube portion 610. This enables the link member 536 to rotate with respect to the slide member 525.

One end (upper side in FIG. 7B) of the link member 536 in the longitudinal direction of the link member 536 is rotatably attached to the link member 535. In other words, the link member 535 and the link member 536 are rotatably connected to each other. In contrast, the other end (lower side in FIG. 7B) of the link member 536 in the longitudinal direction of the link member 536 is rotatably attached to the support member 526. Specifically, holes are respectively formed on the lower side of the link member 536 and the side wall on the left side of the support member 526, and an insertion pin 532 is inserted into these holes. Thus, the link member 536 is rotatably fixed to the support member 526.

Figure 8A:
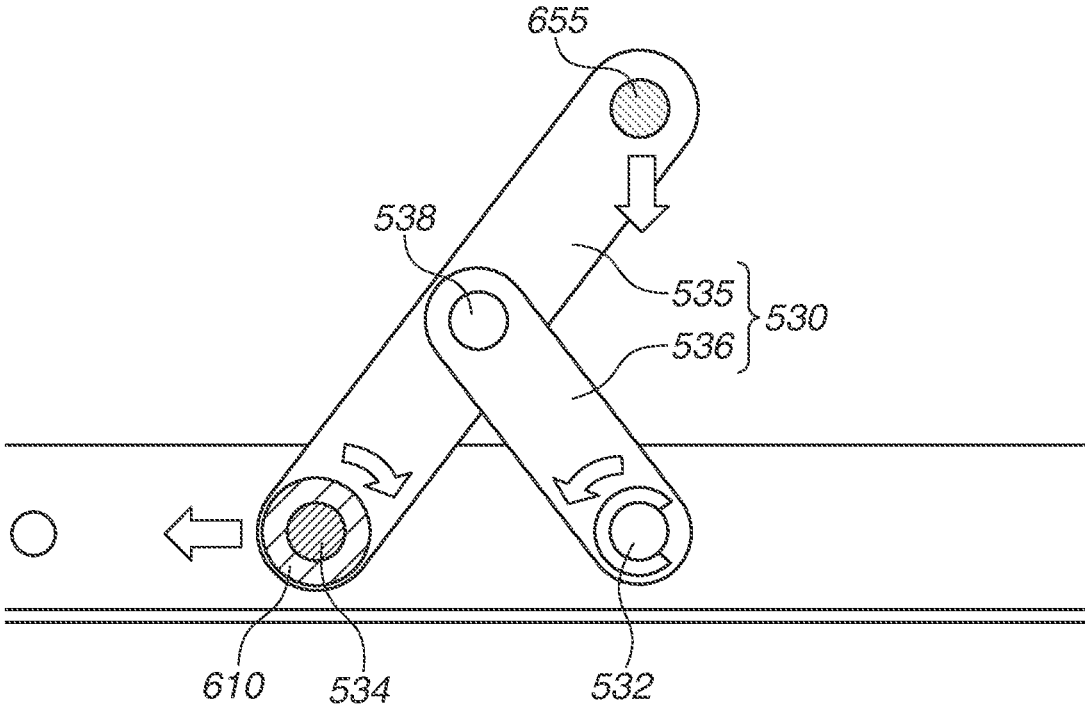
FIGS. 8A and 8B are schematic views each illustrating a mechanism for rotating a first link member and a second link member.
Figure 8B:
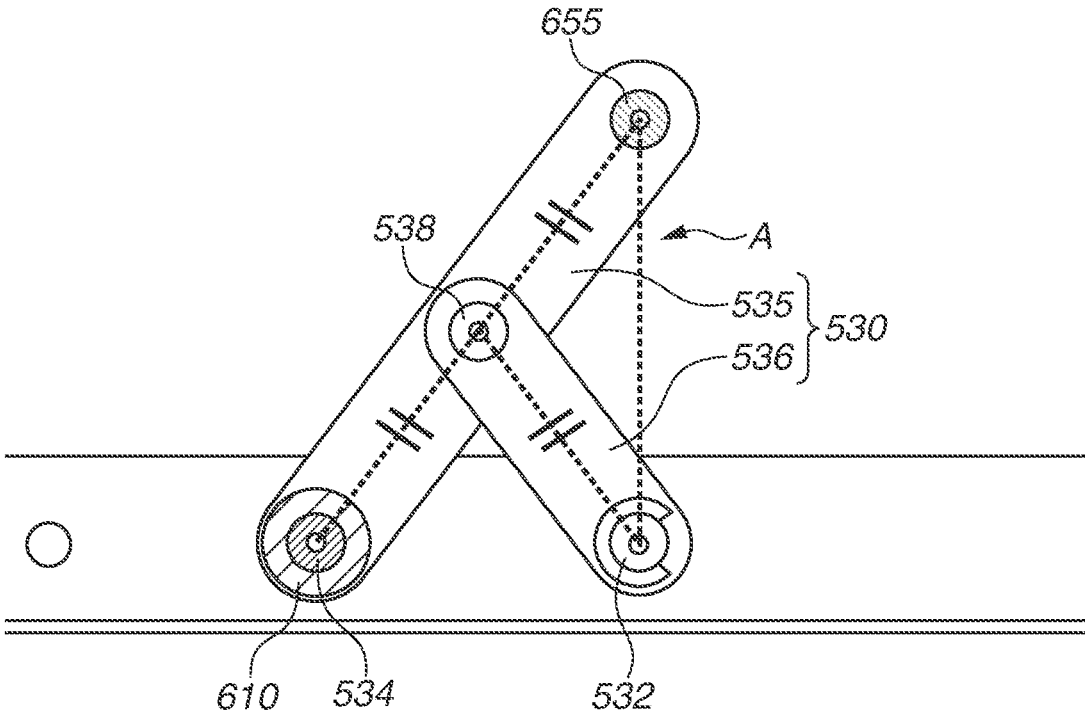

FIGS. 8A and 8B are schematic views each illustrating a state where the link member 535 and the link member 536 included in the link mechanism 530 rotate. As described above, the tube portion 610 formed in the link member 535 is fitted to a protrusion 534 formed on the support member 526. When the slide member 525 slides from the front side to the back side, the link member 535 rotates about the protrusion 534 in the clockwise direction in FIGS. 8A and 8B. Since the link member 535 and the link member 536 are rotatably connected to each other, the link member 536 rotates in the counterclockwise direction with respect to the slide member 525 along with the clockwise rotation of the link member 535. In this case, the link member 536 rotates about the insertion pin 532 with respect to the support member 526. The link member 535 rotates while being rotatably supported by the link member 536, so that the protrusion 655 of the link member 535 moves to the lower side.

Assume that L1 is a distance between the rotational center axis of the link member 535 with respect to the slide member 525 and the center axis of connection between the link member 535 and the link member 536, L2 is a distance between the rotational center axis of the link member 536 with respect to the support member 526 and the center axis of connection between the link member 535 and the link member 536 is represented by, and L3 is a distance between the rotational center axis of the link member 535 with respect to the holding member 505 and the center axis of connection between the link member 535 and the link member 536. The distances L1, L2 and L3 are equal to each other. In general, such a link mechanism is also referred to as a Scott-Russell mechanism. When the distances L1 to L3 are equal to each other, the movement direction of the protrusion 655 along with the slide motion of the slide member 525 coincides with the vertical direction. Specifically, the protrusion 655 moves on a dashed line A illustrated in FIG. 8B. Thus, the holding member 505 can move in the up-down direction along with the slide motion of the slide member 525.

The configuration for moving the optical print head 105 to the exposure position and to the retracted position is not limited to the configuration using the first link mechanism 530 and the second link mechanism 540. However, the configuration may alternatively be using a movement mechanism 940 illustrated in FIGS. 9A and 9B. The movement mechanism 940 will be descried below with reference to FIGS. 9A and 9B. Members having substantially the same functions as those of the members constituting the movement mechanism 940 are denoted by the same reference symbols, and redundant descriptions may be omitted.

Figure 9A:
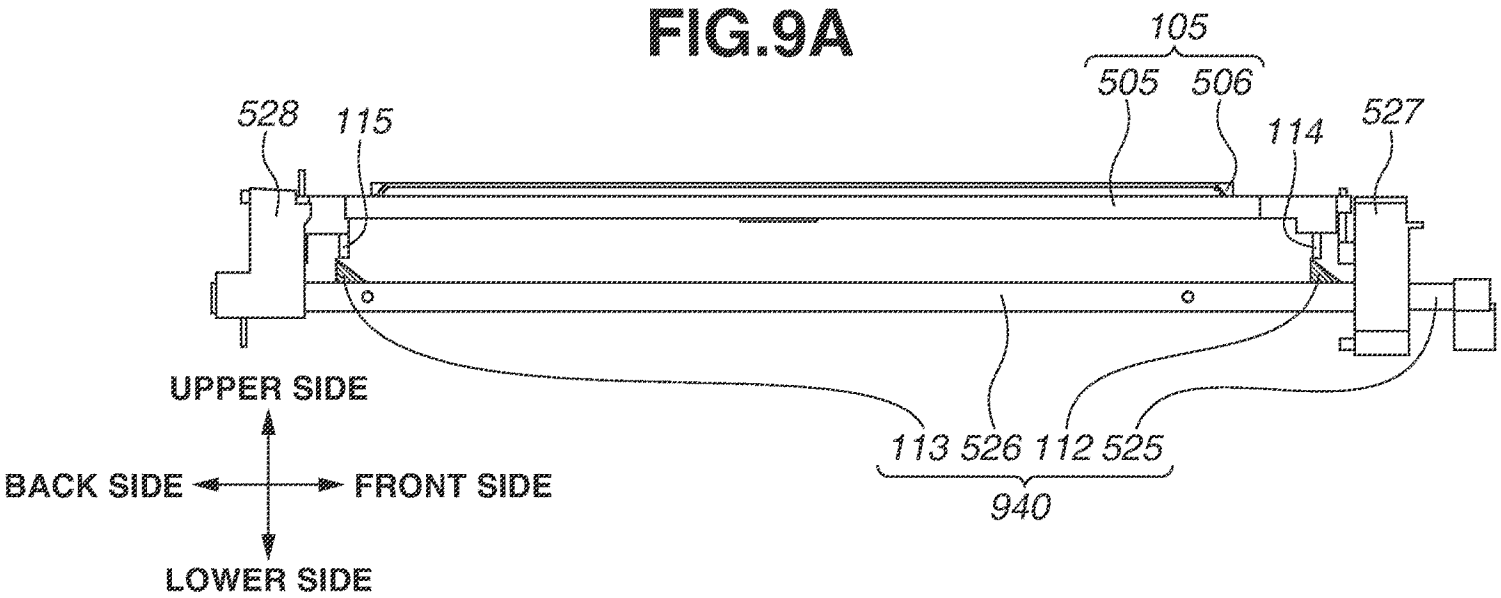
FIGS. 9A and 9B are schematic views each illustrating a cam mechanism as another example of the movement mechanism.
Figure 9B:
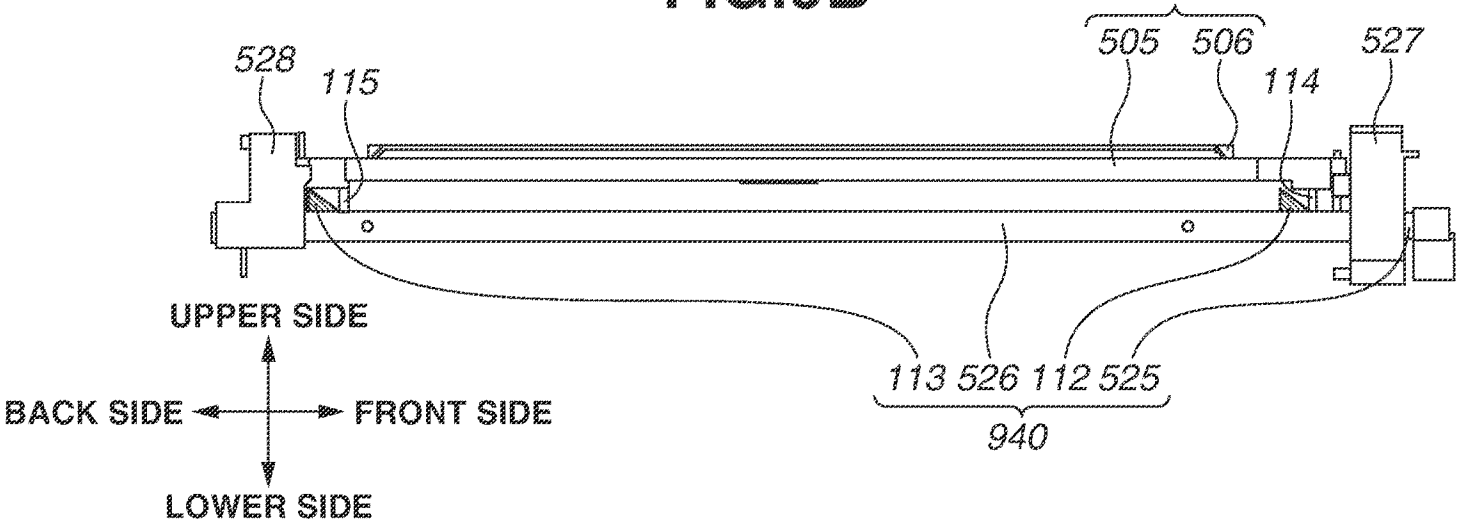

As illustrated in FIGS. 9A and 9B, a first cam portion 112 and a second cam portion 113 are respectively provided on the front side and the back side of the slide member 525. On the front side and the back side of the holding member 505 included in the optical print head 105, a movement support portion 114 and a movement support portion 115 are provided. The first cam portion 112 and the second cam portion 113 each include an inclined surface inclined downward from the back side toward the front side, the surface being formed on the side where the holding member 505 is disposed.

FIG. 9A is a schematic view of the holding member 505 and the movement mechanism 940, which are located at the exposure position, as viewed from the right side. In a case where the holding member 505 included in the optical print head 105 is located at the exposure position when the slide member 525 slides from the front side to the back side with respect to the support member 526, the first cam portion 112 and the second cam portion 113 provided on the slide member 525 moves from the front side to the back side with respect to the support member 526 together with the slide member 525. The lower ends of the movement support portion 114 and the movement support portion 115 provided on the holding member 505 are brought into contact with the first cam portion 112 and the second cam portion 113, respectively, so that the movement support portion 114 and the movement support portion 115 move in a direction from the exposure position to the retracted position along the first cam portion 112 and the second cam portion 113, respectively.

FIG. 9B is a schematic view of the holding member 505 and the movement mechanism 940, which are located at the retracted position, as viewed from the right side. In a case where the holding member 505 included in the optical print head 105 is located at the retracted position when the slide member 525 slides from the back side to the front side with respect to the support member 526, the first cam portion 112 and the second cam portion 113 provided on the slide member 525 slide from the back side to the front side with respect to the support member 526 together with the slide member 525. The lower ends of the movement support portion 114 and the movement support portion 115 provided on the holding member 505 are thus pushed up and moved in a direction from the retracted position to the exposure position along the first cam portion 112 and the second cam portion 113, respectively.

(Cleaning Mechanism)

The optical print head 105 is located near the photosensitive drum 103 and the developing device 106. Toner may thus adhere to the light-emitting surface of the lens array 506. If dust, such as toner, adheres to the light-emitting surface of the lens array 506, light traveling from each LED 503 to the photosensitive drum 103 may be partially blocked, which may cause an image formation failure. It may be desirable to periodically remove dirt adhering to the light-emitting surface of the lens array 506, accordingly.

Figure 10:
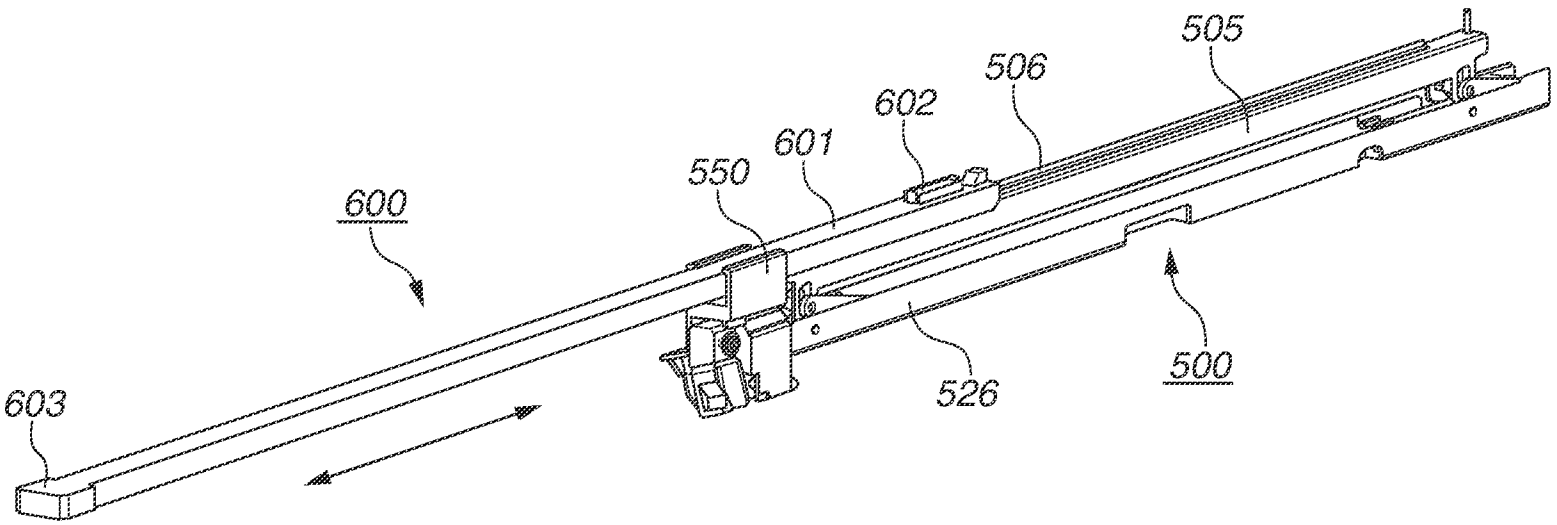
FIG. 10 is a schematic perspective view of a cleaning mechanism.

In this regard, a mechanism for cleaning the light-emitting surface of the lens array 506 by inserting or removing a rod-shaped cleaning stick from the outside of the image forming apparatus 1 is known. FIG. 10 is a schematic perspective view illustrating a state where the cleaning member 600 is inserted from the outside of the apparatus body of the image forming apparatus 1. A plate-shaped blade is provided at a leading end of the cleaning member 600. When the operator inserts or removes the cleaning member 600 into or from the image forming apparatus 1, the blade rubs the surface of the lens array 506. As illustrated in FIG. 10, the insertion portion 550 into which the cleaning member 600 is inserted is integrally formed with the support member 526 included in the exposure unit 520. The support member 526 is fixed to the apparatus body of the image forming apparatus 1. The support member 526 is also fixed to the apparatus body, accordingly. The insertion portion 550 need not necessarily be formed on the support member 526. For example, the insertion portion 550 may be formed on a member fixed to the apparatus body, or may be formed on the drum unit 518.

As illustrated in FIG. 10, the insertion portion 550 includes walls facing the right side surface and the left side surface of the inserted cleaning member 600 so as to limit the movement in the left-right direction of the cleaning member 600 inserted into the insertion portion 550. Upper portions of the walls are bent into an L-shape so that the cleaning member 600 is grabbed between the walls. This configuration limits the upward movement of the cleaning member 600 inserted into the insertion portion 550. In other words, the vertical movement of the cleaning member 600 inserted into the insertion portion 550 with respect to directions (directions indicated by arrows in FIG. 10) in which the cleaning member 600 is inserted into or removed from the insertion portion 550 is limited by the insertion portion 550. In other words, the insertion portion 550 guides the movement of the cleaning member 600 in the directions indicated by the arrows in FIG. 10.

In a state where the cleaning member 600 is inserted into the insertion portion 550, there is a small gap between the cleaning member 600 and the insertion portion 550. In the present exemplary embodiment, the gap between the insertion portion 550 and the cleaning member 600 inserted into the insertion portion 550 in the left-right direction is about 2 mm. In the up-down direction, a gap is also formed between an upper portion of the insertion portion 550 and the cleaning member 600 in the state where the cleaning member 600 is inserted into the insertion portion 550 and is in contact with a bottom surface of the insertion portion 550 is about 2 mm. As described above, a small gap is formed between the cleaning member 600 and the insertion portion 550 in the state where cleaning member 600 is inserted into the insertion portion 550. This enables the operator to smoothly insert or remove the cleaning member 600 into or from the insertion portion 550.

In the state where the cleaning member 600 is inserted into the insertion portion 550, however, a leading end of the cleaning member 600 may be moved upward with the insertion portion 550 as a fulcrum and the cleaning member 600 may be separated from the light-emitting surface of the lens array 506. This is because a small gap is formed between the cleaning member 600 and the insertion portion 550 in the up-down direction when the operator applies a downward force to the grip portion 603. If the operator inserts or removes the cleaning member 600 into or from the insertion portion 500 in this state, there is a possibility that the blade provided at the leading end of the cleaning member 600 cannot rub the light-emitting surface of the lens array 506.

In contrast, in the state where the cleaning member 600 is inserted into the insertion portion 550, the operability deteriorates as the size of the gap between the cleaning member 600 and the insertion portion 550 decreases, while the cleaning member 600 is inserted into the insertion portion 550 from the outside of the apparatus body deteriorates. Specifically, if a certain clearance is secured between the cleaning member 600 and the insertion portion 500 in the state where the cleaning member 600 is inserted into the insertion portion 550, the operator can easily insert the cleaning member 600 into the insertion portion 550.

(Ground Mechanism)

Since the holding member 505 is made of metal, the holding member 505 may be charged, for example, when the cleaning member 600 rubs the holding member 505. Since the holding member 505 holds the substrate 502, electricity may be discharged from the holding member 505 to the substrate 502 if the holding member 505 is charged. For this reason, it may be desirable to ground the holding member 505.

Figure 11:
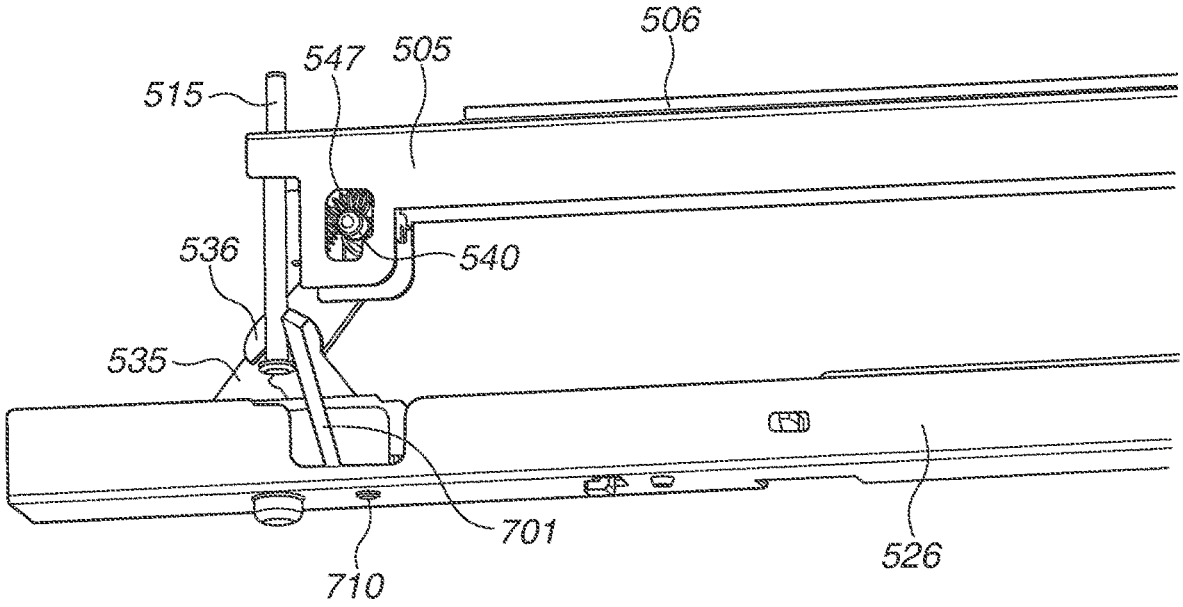
FIG. 11 is a schematic view of a ground mechanism.

FIG. 11 is a schematic view of a ground mechanism according to the present exemplary embodiment. The support member 526 made of metal is supported by the front side plate 642 provided on the front side of the image forming apparatus 1 and the back side plate 643 provided on the back side of the image forming apparatus 1. The support member 526 is thus grounded through one or both of the front side plate 642 and the back side plate 643.

A metal plate spring 701 is attached to the back side of the support member 526 with a screw 710. A leading end of the plate spring 701 contacts the contact pin 515 as illustrated in FIG. 11. The plate spring 701 is elastically deformed. The contact pin 515 is pressed in the rotational axis direction of the photosensitive drum 103 by the restoring force of the plate spring 701. Specifically, the plate spring 701 presses the contact pin 515 in a direction from the front side to the back side of the image forming apparatus 1. Since the plate spring 701 is constantly pressed against the contact pin 515 by an elastic force, the holding member 505 can be reliably grounded through the contact pin 515. In the present exemplary embodiment, the plate spring 701 is used as a member through which the holding member 505 is grounded, but instead a wire spring or other types can be used. Instead of using a plate spring or a wire spring, the contact pin 515 and the holding member 526 may be directly connected with a conductor so as to obtain an advantageous effect that the holding member 505 can be grounded. However, since the optical print head 105 according to the present exemplary embodiment moves to the exposure position and to the retracted position, if the contact pin 515 and the holding member 526 are connected with a conducting wire, the conducting wire may be deformed when the optical print head 105 is located at the retracted position. If the deformed conducting wire is caught on, for example, the link member 535 (536), the conducting wire may be damaged. Accordingly, it may be desirable to separately perform a process for laying out the conducting wire. Therefore, it may be preferable to use the plate spring 701, like in the present exemplary embodiment, so as to obtain the advantageous effect that the holding member 505 can be grounded.

Figure 12A:
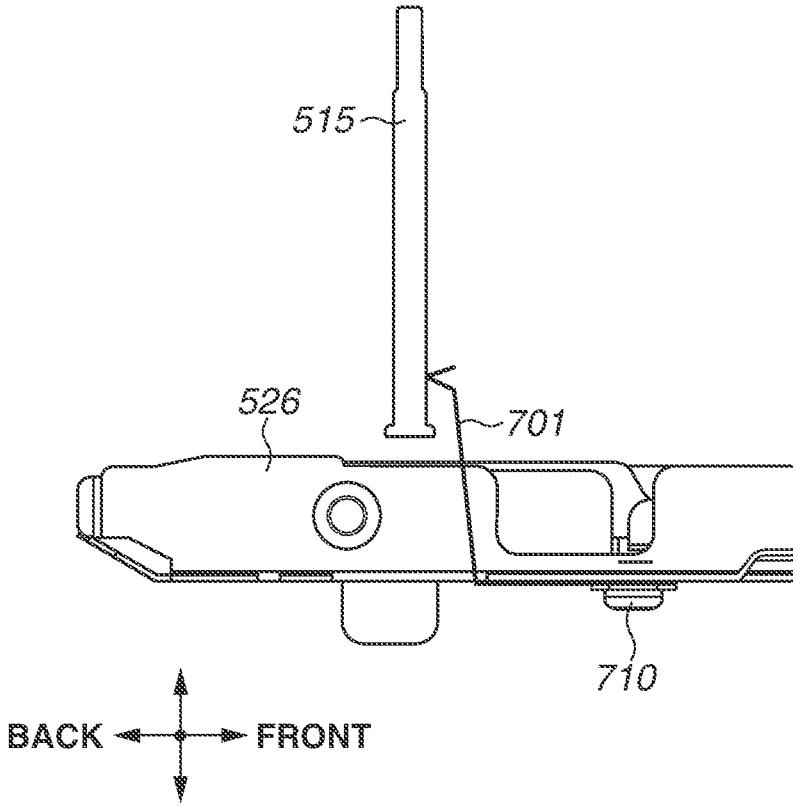
FIGS. 12A and 12B each illustrate a plate spring used for grounding a holding member through a pin.
Figure 12B:
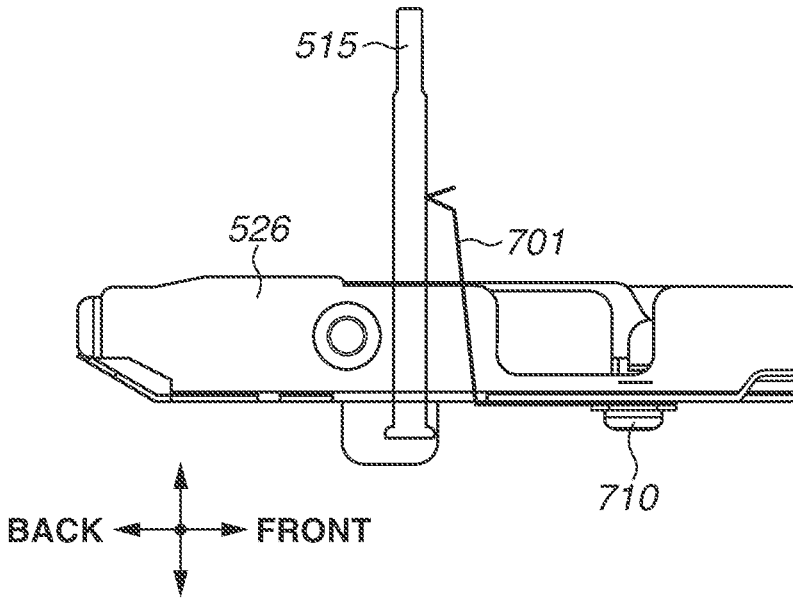

FIG. 12A illustrates a positional relationship between the contact pin 515 and the plate spring 701 when the holding member 505 is located at the exposure position. FIG. 12B illustrates a positional relationship between the contact pin 515 and the plate spring 701 when the holding member 505 is located at the retracted position. To simplify the illustration in FIGS. 12A and 12B, the holding member 505 is omitted. As is seen from the drawings, even when the contact pin 515 moves together with the holding member 505 that moves to the exposure position and to the retracted position, the plate spring 701 is constantly in contact with the contact pin 515. In other words, the contact pin 515 moves together with the holding member 505 while being in contact with the plate spring 701. The holding member 505 is constantly grounded through the contact pin 515, accordingly.

In the present exemplary embodiment, the plate spring 701 is in contact with the contact pin 515 in a direction (rotational axis direction of the photosensitive drum 103) orthogonal to the optical axis of the lens array 506. Alternatively, the holding member 505 may be pressed in a direction along the optical axis of the lens array 506. However, in this configuration, if dust, such as toner, accumulates the gap between the plate spring 701 and the holding member 505, there is a possibility that the holding member 505 cannot be sufficiently grounded. On the other hand like in the present exemplary embodiment, it is less likely that dust, such as toner, accumulates the gap between the plate spring 701 and the holding member 505 in the configuration in which the plate spring 701 presses the holding member 505 in the direction orthogonal to the optical axis direction of the lens array 506. This is because a gravitational force acts on the holding member 505. The direction in which the plate spring 701 presses the contact pin 515 may be preferably set to the direction orthogonal to the optical axis direction of the lens array 506, accordingly.

According to the present exemplary embodiment, in the configuration for moving the optical print head 105 using the link mechanisms, the link members constituting the link mechanisms are disposed along the longitudinal direction of the holding member 505. Since each of the drum units 518, the charging devices 104, and the developing units 641 are disposed in the vicinity of each of the optical print heads 105, a sufficient space cannot be secured. In particular, a sufficiently large space cannot be secured in the direction orthogonal to each of the vertical direction and the longitudinal direction of the optical print heads 105, i.e., in the left-right direction of the image forming apparatus 1. The link members constituting the link mechanisms are thus disposed along the longitudinal direction of the holding member 505, thereby suppressing an increase in the size of the exposure unit 520 itself in the left-right direction. In this case, the plate spring 701 is provided on the holding member 526 such that the plate spring 701 presses the contact pin 515 in a direction from the front side to the back side, or in a direction from the back side to the front side, thereby suppressing an increase in the size of the exposure unit 520 in the left-right direction. In other words, in order to suppress an increase in the size of the exposure unit 520 in the left-right direction, the plate spring 701 and the contact pin 515 may be desirably in contact with each other in the direction vertical to each of the movement direction of the optical print head 105 and the longitudinal direction of the optical print head 105.

The holding member 505 is grounded through the contact pin 515 protruding from the holding member 505 toward the side opposite to the side where the photosensitive drum 103 is disposed with respect to the holding member 505 in the optical axis direction of the lens array 506. The length of the plate spring 701 can thereby be reduced. If the plate spring 701 has a long length, it is difficult to adjust the elastic force, so that the holding member 505 may be pressed in an undesirable manner. If the holding member 505 is grounded through the contact pin 515, the distance between the holding member 505 and the support member 526 does not increase even in a case where the amount of movement of the holding member 505 by the movement mechanism increases. It is therefore possible to reduce the possibility that a ground path may be disconnected.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2019-223283, filed Dec. 10, 2019, which is hereby incorporated by reference herein in its entirety.

What is claimed is:

1. An image forming apparatus comprising:

a photosensitive member unit including a photosensitive member;

a holder made of metal, the holder being configured to hold a substrate and a lens, wherein a light-emitting element configured to emit light for exposing the photosensitive member is mounted on the substrate, and wherein the lens is configured to focus the light emitted from the light-emitting element onto the photosensitive member;

a pin provided on the holder on one side of the lens in a longitudinal direction of the holder, the pin being brought into contact with a frame of the photosensitive member unit to form a gap between the photosensitive member and the lens, the pin protruding from both sides of the holder in an optical axis direction of the lens;

a support member configured to support the holder, and including a slider configured to slide along the holder in the longitudinal direction;

a first link member made of resin, the first link member having one end rotatably connected to one end of the holder in the longitudinal direction, and having another end rotatably connected to one end of the slider in the longitudinal direction;

a second link member made of resin, the second link member having one end rotatably connected to another end of the holder in the longitudinal direction, and having another end rotatably connected to another end of the slider in the longitudinal direction; and a conductive member made of metal and grounded, the conductive member being in contact with a side surface of the pin between one end of the pin and an other end of the pin in a longitudinal direction of the pin, wherein the first link member and second link member rotate with respect to the slider along with a slide motion of the slider to move the holder to a first position, where the pin contacts the frame, and to a second position, farther from the photosensitive member than the first position.

2. The image forming apparatus according to claim 1, further comprising a slider support member made of metal and configured to support the slider, a position of the slider support member with respect to the photosensitive member unit being fixed, wherein the conductive member is attached to the slider support member.

3. The image forming apparatus according to claim 2, further comprising:

a front side plate made of metal, one end of the slider support member in the longitudinal direction being fixed to the front side plate; and a back side plate made of metal, another end of the slider support member in the longitudinal direction being fixed to the back side plate.

4. The image forming apparatus according to claim 1, wherein the conductive member is a plate-shaped spring and configured to press the pin from one side of the pin in the longitudinal direction.

5. The image forming apparatus according to claim 1, wherein the holder exposes the photosensitive member from a lower side of the photosensitive member in a vertical direction.

6. The image forming apparatus according to claim 1, wherein the light-emitting element is a light-emitting diode (LED).

7. The image forming apparatus according to claim 1, wherein the light-emitting element is an organic light-emitting diode (OLED).

8. The image forming apparatus according to claim 1, wherein the conductive member is in contact with a portion, of the pin, protruding from the holder in a direction away from the photosensitive member.

* * * * *